US007441886B2

(12) United States Patent
Chen

(10) Patent No.: US 7,441,886 B2
(45) Date of Patent: Oct. 28, 2008

(54) FUSED INK-JET IMAGE WITH HIGH IMAGE QUALITY, AIR FASTNESS, AND LIGHT STABILITY

(75) Inventor: Tienteh Chen, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 351 days.

(21) Appl. No.: 10/773,826

(22) Filed: Feb. 5, 2004

(65) Prior Publication Data

US 2005/0174415 A1 Aug. 11, 2005

(51) Int. Cl.
*B41J 2/01* (2006.01)

(52) U.S. Cl. ..... 347/105; 347/101; 428/32.1

(58) Field of Classification Search ..... 347/105, 347/101, 102; 428/195, 32.1
See application file for complete search history.

(56) References Cited

U.S. PATENT DOCUMENTS 4,929,590 A * 5/1990 Maruta et al. ..... 427/152
6,352,805 B1 * 3/2002 Taylor et al. ..... 347/105
6,358,306 B1 * 3/2002 Hanada et al. ..... 428/447
6,497,480 B1 * 12/2002 Wexler ..... 347/105
6,677,005 B2 1/2004 Kaneko et al.
6,677,007 B1 * 1/2004 Warner et al. ..... 428/32.34
6,692,799 B2 2/2004 Waller, Jr.
6,814,437 B2 * 11/2004 Wexler ..... 347/105
6,833,169 B2 * 12/2004 Kasperchik et al. ..... 428/32.24

FOREIGN PATENT DOCUMENTS

| | | |
|---|---|---|
| EP | 1293356 | 3/2003 |
| FR | 2 805 204 | 8/2001 |
| JP | H7276785 | 10/1995 |
| JP | H11291612 | 10/1999 |
| JP | 200348391 | 3/2003 |

* cited by examiner

*Primary Examiner*—Manish S. Shah

(57) ABSTRACT

A media sheet can comprise a media substrate, an ink receiving layer applied as a coating to at least one surface of the substrate, and a UV protection layer applied as a coating to the ink receiving layer. The ink receiving layer can include hollow particulates, and the UV protection layer can include UV absorbing latex particulates. This media substrate can be used in a system wherein a dye-based ink-jet ink is printed thereon, and a fusion system is configured to fuse UV protection layer and the ink receiving layer after printing of the ink-jet ink, thereby forming an ink-jet image with high image quality, air fastness, and light stability.

37 Claims, 1 Drawing Sheet

FUSED INK-JET IMAGE WITH HIGH IMAGE QUALITY, AIR FASTNESS, AND LIGHT STABILITY

FIELD OF THE INVENTION

The present invention relates generally to the preparation of fused ink-jet images having high image quality, air fastness, and light stability. More particularly, the present invention relates to systems and methods for preparing fused ink-jet images, and resulting fused ink-jet produced prints.

BACKGROUND OF THE INVENTION

Ink-jet imaging has evolved to a point where very high-resolution images can be transferred to various types of media, including paper. Generally, ink-jet printing involves the placement of small drops of a fluid ink onto a media surface in response to a digital signal. Typically, the fluid ink is placed or jetted onto the surface without physical contact between the printing device and the surface. Within this general technique, the specific method that the ink-jet ink is deposited onto the printing surface varies from system to system, and can include continuous ink deposit and drop-on-demand ink deposit. Regarding drop-on-demand printing systems, the ink-jet inks are typically based upon water and solvents such as glycols. Essentially, with these systems, ink droplets are propelled from a nozzle by heat or by a pressure wave such that all of the ink droplets ejected are used to form the printed image.

There are several reasons that ink-jet printing has become a popular way of recording images on various media surfaces, particularly paper. Some of these reasons include low printer noise, capability of high-speed recording, and multi-color recording. Additionally, these advantages can be obtained at a relatively low price to consumers. However, though there has been great improvement in ink-jet printing, accompanying this improvement are increased demands by consumers in this area, e.g., higher speeds, higher resolution, full color image formation, increased stability, etc. As new ink-jet inks and accompanying printing systems are developed, there have been several traditional characteristics to consider when evaluating the ink in conjunction with a printing surface or substrate. Such characteristics include edge acuity and optical density of the image on the surface, black to color bleed control, dry time of the ink on the substrate, adhesion to the substrate, lack of deviation in ink droplet placement, presence of all dots, resistance of the ink after drying to water and other solvents, long term storage stability, and long term reliability without corrosion or nozzle clogging. Though the above list of characteristics provides a worthy goal to achieve, there are difficulties associated with satisfying all of the above characteristics. Often, the inclusion of an ink component meant to satisfy one of the above characteristics can prevent another characteristic from being met. Thus, most ink-jet printing systems represent a compromise in an attempt to achieve at least an adequate response in meeting all of the above listed requirements.

Media preparation and post processing of printed images has also been used to improve properties of print quality. As such, research continues with respect to systems that include specialty media preparation, ink-jet ink choice and preparation, and post processing of printed images.

SUMMARY OF THE INVENTION

It has been recognized that it would be advantageous to provide systems and methods for producing printed images that have good image quality, as well as have good air fade resistance and light fade resistance. In accordance with this, a media sheet can comprise a media substrate, an ink receiving layer, and a UV protection layer. The ink receiving layer can be applied as a coating to at least one surface of the substrate, and the ink receiving layer can comprise hollow particulates. The UV protection layer can be applied as a coating to the ink receiving layer, and the UV protection layer can comprise UV absorbing latex particulates.

In another embodiment, a system for preparing a fused ink-jet image can comprise a media sheet, an ink-jet ink, and a fusion system. The media sheet can include a media substrate, an ink receiving layer applied as a coating to at least one surface of the substrate, wherein the ink receiving layer comprises hollow particulates, and a UV protection layer applied as a coating to the ink receiving layer, wherein the UV protection layer comprises UV absorbing latex particulates. The ink-jet ink can include a dye, and can be configured for printing onto the media sheet, wherein upon printing, the ink-jet ink substantially passes through the UV protection layer and is taken within voids of the hollow particulates. The fusion system can be configured to fuse the UV protection layer and the ink receiving layer after printing of the ink-jet ink.

In another embodiment, a method of preparing a fused ink-jet image can comprise ink-jetting an ink-jet ink onto a media sheet including an ink receiving layer and a UV protection layer, and fusing the UV protection layer and the ink receiving layer after the ink-jetting step. The ink-jet ink can include a dye, the ink receiving layer can include hollow particulates, and the UV protection layer can include UV absorbing latex particulates.

Additional features and advantages of the invention will be apparent from the detailed description which follows, taken in conjunction with the accompanying drawings, which together illustrate, by way of example, features of the invention.

DETAILED DESCRIPTION OF THE PREFERRED EMBODIMENT(S)

Figure 1:
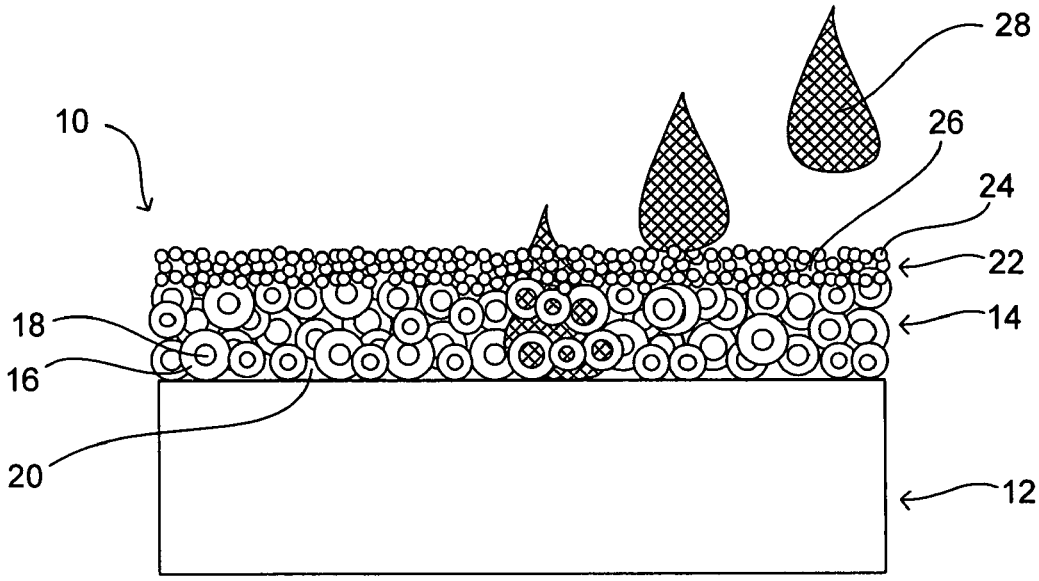
FIG. 1 depicts a side cutaway sectional view of a portion of a media sheet used in accordance with embodiments of the present invention.

Before particular embodiments of the present invention are disclosed and described, it is to be understood that this invention is not limited to the particular process and materials disclosed herein as such may vary to some degree. It is also to be understood that the terminology used herein is used for the purpose of describing particular embodiments only and is not intended to be limiting, as the scope of the present invention will be defined only by the appended claims and equivalents thereof.

In describing and claiming the present invention, the following terminology will be used.

The singular forms "a," "an," and "the" include plural referents unless the context clearly dictates otherwise. Thus, for example, reference to "a dye" includes reference to one or more of such materials.

The term "substrate" refers to media substrates that can be coated with ink receiving layers and UV protection layers in accordance with embodiments of the present invention. The substrate can be paper, photobase, plastic media such as clear to opaque plastic film, and the like.

The term "hollow particulate(s)" refers to plastic pigments and the like that include one or more void(s) within the outer dimension of the pigment volume. For example, in one embodiment, hollow particulates can have a void volume from 30% to 70%. In another embodiment, hollow particulates can have a particulate size from 0.3 μm to 5 μm and/or a glass transition temperature (Tg) from 50° C. to 120° C.

The term "ink receiving layer" refers to compositions that include hollow particulates that can be coated on media substrates. The ink receiving layer is configured to receive ink within the pores provided by the hollow particulates, and by the space between hollow particulates. Typically, the coating also includes binder material used to bind the hollow particulates together. Typically binder material that can be used includes polyvinyl alcohol, gelatin, PVP, and/or low glass transition temperature (Tg<20° C.) emulsion polymers, for example. An amount of binder can be used that functionally binds together the hollow particulates, but still leaves space between and within the hollow particulates such that ink can be received within the ink receiving layer upon printing.

The term "UV absorbing latex particulate(s)" refers to polymers or copolymers that include at least one UV absorbing monomer polymerized therein. The UV absorbing latex particulates can be prepared by polymerizing UV absorbing monomers to form homopolymer latex particulates, or copolymerizing UV absorbing monomers with other UV absorbing or non-UV absorbing monomers to form copolymers. A UV absorbing monomer typically has relatively strong absorbance between 300 to 420 nm, and very low absorbance beyond 420 nm. In accordance with one standard, to qualify as a UV absorbing compound or agent, a minimum extinction coefficient of 5000 at from 300 nm to 420 nm is typically present. In accordance with the present invention, UV absorbing latex particulates are usually dimensionally smaller that hollow particulates, though this is not required. The UV absorbing latex particulates can be from 0.05 μm to 1 μm in size, and can have a glass transition temperature (Tg) from 50° C. to 100° C.

The term "UV protection layer" refers to compositions that include UV latex particulates, and optionally, other ingredients that can be used to facilitate adhesion and coating properties. This layer can be coated on top of the ink receiving layer. For example, a UV protection layer can include binder material and pH adjusting material, as well as other modifying substances. A function of the UV protection layer is to allow printed ink to substantially pass therethrough, such that much of the ink is taken by the ink receiving layer. Thus, upon fusing, the UV absorbing latex particulates and the hollow particulates act to form a barrier, protecting the ink from the air. The fused UV absorbing latex particulates provide a second function of protecting the printed ink from undesired UV radiation.

"Binder" or "polymeric binder" includes any substance that can be used to bind particulates together, such as hollow particulates or UV latex particulates. The binder is typically used in an amount that binds the particulates together, but still leaves voids between the particulates for receiving ink or allowing ink to pass therethrough.

The term "fuse," "fusion," "fusing," or the like, refers to the state of a printed image (or the process of obtaining a printed image) that has been at least partially melted such that an ink receiving layer and a UV protection layer form a film that protects ink-jet ink printed therein or thereon. Fusion can occur by applying heat and/or pressure, and preferably both, to a printed image. The amount of heat and/or pressure applied is material dependent, but generally, can be from 100° C. to 250° C. and/or from 50 psi to 300 psi.

The term "ink-jet ink" refers to ink-jettable compositions that include a liquid vehicle and a dye. Optionally, other ingredients can be present in the liquid vehicle as well, such as latex polymers, polymer dispersions, pigments, UV curable materials, plasticizers, antioxidants, light stabilizers, oxygen scavengers, etc.

As used herein, "liquid vehicle" can include liquid compositions that can be used to carry dyes and/or other substances to a substrate. Liquid vehicles are well known in the art, and a wide variety of ink vehicles may be used in accordance with embodiments of the present invention. Such ink vehicles can include a mixture of a variety of different agents, including without limitation, surfactants, solvents, co-solvents, buffers, biocides, viscosity modifiers, sequestering agents, stabilizing agents, and water.

The term "substantially" when used with another term shall include from mostly to completely.

Ratios, concentrations, amounts, and other numerical data numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight range of about 1 wt % to about 20 wt % should be interpreted to include not only the explicitly recited concentration limits of 1 wt % to about 20 wt %, but also to include individual concentrations such as 2 wt %, 3 wt %, 4 wt %, and sub-ranges such as 5 wt % to 15 wt %, 10 wt % to 20 wt %, etc. Further, a range recited to be less than 10 wt % in intended to include 0 wt %.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIG. 1, a media sheet, indicated generally at 10, in accordance with embodiments of the present invention is shown. The system includes a substrate 12, which can be paper media, photobase, from clear to opaque plastic film, or other known media substrate. Coated on the substrate is an ink receiving layer 14 and a UV protection layer 22. Ink-jet ink 28 is also shown as it is applied to the media sheet. Though not shown, the substrate can be coated on both sides to form a media sheet that can be printed on both sides.

Referring specifically to the ink receiving layer 14, typically, this layer can comprise hollow particulates 16 and binder material 20. The hollow particulates typically have one or more voids 18 within the outer dimension of the hollow particulate volume. For example, hollow particulates can have a void volume from 30% to 70%. In one embodiment, the hollow particulates can have a particulate size from 0.3 um to 2 um and/or a glass transition temperature (Tg) from 50° C. to 120° C. Examples of hollow particulates that can be used in accordance with embodiments of the present invention include Ropaque HP-543 HP-643, HP-1055, and OP-96 (Rohm-Haas), and Dow HS-3000NA and HS-2000NA (Dow Chemical). Examples of binders that can be used to bind the hollow particulates together include water soluble polymers such as polyvinyl alcohol, cationic polyvinylalcohol, acetoacetylated polyvinylalcohol, silylated polyvinylalcohol, carboxylated polyvinylalcohol, polyvinylpyrrolidone, copolymers of polyvinylacetate and polyvinylpyrrolidone, copolymers of polyvinylalcohol and polyvinylpyrrolidone, cationic polyvinylpyrrolidone, gelain, hydroxyethylcellulose, methyl cellulose, and low glass transition temperature (Tg<20° C.) polymer latex (such as styrene butadiene latex, styrene acrylic latex, vinyl acrylic latex, acrylic latex, polyurethane dispersions, and polyester dispersions), and low glass transition temperature (Tg<20° C.) emulsion polymers.

When preparing the ink receiving layer composition, the hollow particulate to binder ratio can be adjusted to promote desired properties. Appropriate ratios within this range can provide coatings that avoid unwanted cracking upon drying, and at the same time, provide hollow particulate to hollow particulate adhesion within the coating while maintaining voids within and around the hollow particulates. In one embodiment, the hollow particulate to binder ratio can be from 95:5 to 50:50 by weight. The ink receiving layer, which can include the hollow particulates and the binder material, can be applied to the substrate 12 at a coating weight from 5 $g/m^2$ to 40 $g/m^2$. In a more detailed aspect, the coating weight can be from 10 $g/m^2$ to 20 $g/m^2$.

Referring now to the UV protection layer 22, typically, this layer can comprise UV absorbing latex particulates 24, and optionally, binder 26. The UV absorbing latex particulates can be prepared by polymerizing UV absorbing monomers to form homopolymer latex particulates, or copolymerizing UV absorbing monomers with other UV absorbing or non-UV absorbing monomers to form copolymer latex particulates. The UV absorbing latex particulates can be prepared by emulsion polymerization or other known techniques, and can also include cationic monomers (mordants) and other diluent monomers, such as to improve physical or other properties of the latex. When applying the UV protection layer to the ink receiving layer 14, a coating weight of application can be from 0.2 $g/m^2$ to 5 $g/m^2$, and in a more detailed embodiment, can be from 1 $g/m^2$ to 3 $g/m^2$.

In more detail with respect to the preparation of the UV absorbing latex particulates for use in the UV absorbing layer, UV absorbing monomers can be used that include an ethylenically unsaturated compound. In one embodiment, a UV absorbing monomer can have at least relatively strong absorbance between 300 nm to 420 nm, and very low absorbance above 420 nm. In accordance with one standard, to qualify as a UV absorbing compound or agent, the extinction coefficient of the compound will typically have a minimum extinction coefficient of 5000 in this frequency region. Suitable UV absorbing monomers that can be used in accordance with embodiments of the present invention include those shown in Formula 1 below:

(Formula 1)

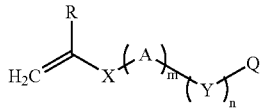

where R can be hydrogen, chlorine, or C1-C4 lower alkyl, e.g., methyl, ethyl, n-propyl, isopropyl; X can be —CONH—, —COO—, or phenylene; A can be a linking group such as C1-C20 alkylene, e.g., methylene, ethylene, trimethylene, 2-hydroxytrimethylene, pentamethylene, etc., or C6-C20 arylene, e.g., phenylene, etc.; Y can be —COO—, —OCO—, —CONH—, —NHCO—, $SO_2NH$—, $NHSO_2$—, —$SO_2$—, or —O—; m can be 0 or 1; n can be 0 or 1; and Q can be a UV absorbing group. Schematic structures of Q are shown in Formulas 2a-2i as follows (single bond represents an exemplary point of attachment to the composition set forth in Formula 1):

(Formula 2a)

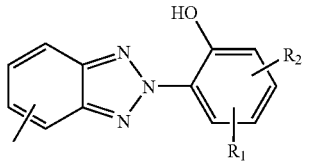

(Formula 2b)

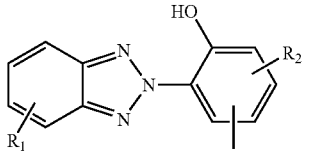

(Formula 2c)

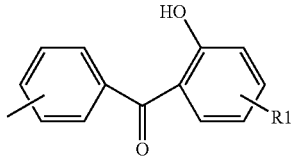

(Formula 2d)

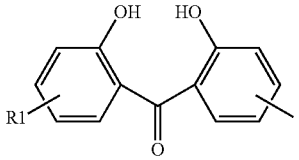

(Formula 2e)

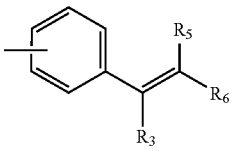

-continued (Formula 2f)

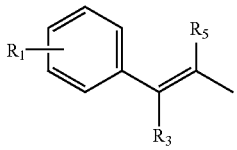

(Formula 2g)

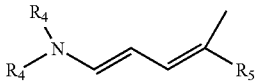

(Formula 2h)

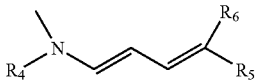

(Formula 2i)

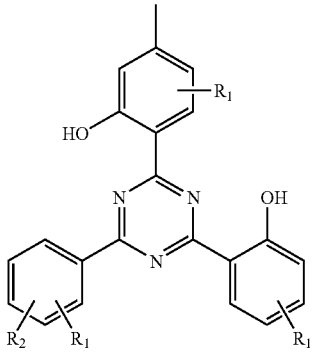

In the above UV absorbing group structures, R1 and R2 can each independently represent hydrogen, alkyl, alkenyl, alkoxy, alkoxycarbonyl, halogen, hydroxy, alkoxycarbamoyl, aliphatic amido, alkylsulfamoyl, alkylsulfonamido, alkylureido, arylcarbamoyl, arylamido, arylsulfamoyl, arylsulfonamido, arylureido, carboxyl, sulfo, nitro, cyano, or thiocyano, for example. R3 can be aryl, substituted aryl, or a hetereocyclic group. R4 can be hydrogen, C1-C4 alkyl, C1-C4 hydroxyalkyl, or C1-C4 sulfoalkyl. R5 and R6 can each be cyano; aryl, e.g., phenyl or tolyl; alkyl, e.g., methyl, ethyl, butyl, or hexyl; alkoxycarbonyl, e.g., ethoxycarbonyl or propoxycarbonyl; arylsulfonyl, e.g., phenylsulfonyl; or alkylsulfonyl, e.g., methylsulfonyl. It should also be noted that a line without a group showing at its terminal end indicates exemplary locations where attachment between the Y and Q can occur in accordance with Formula 1.

Examples of ethylenically unsaturated UV monomers which can be used in preparing a UV absorbing layer of the present invention include, but are not limited to, the following examples (UV-1 to UV-19):

(UV-1)

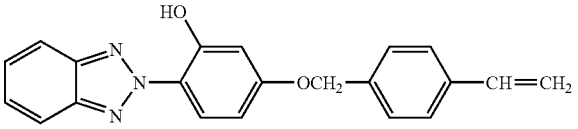

-continued (UV-2)

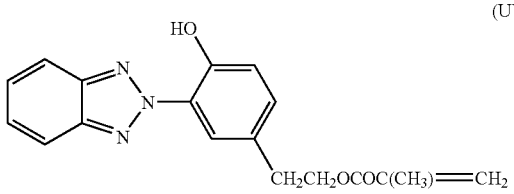

(UV-3)

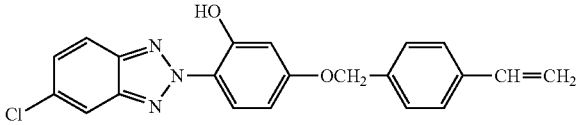

(UV-4)

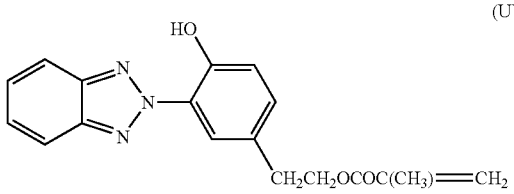

(UV-5)

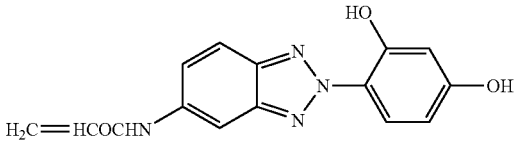

(UV-6)

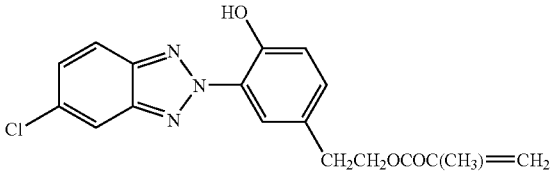

(UV-7)

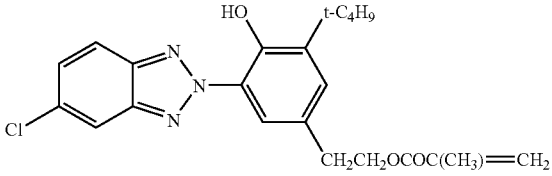

(UV-8)

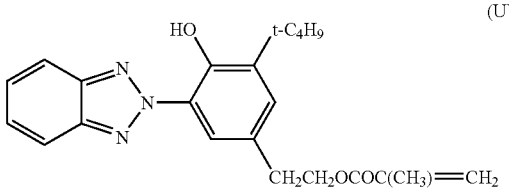

(UV-9)

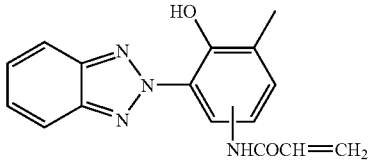

-continued (UV-10)

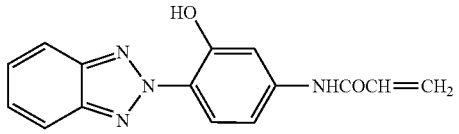

(UV-11)

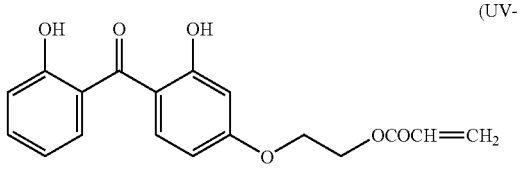

(UV-12)

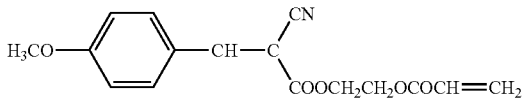

(UV-13)

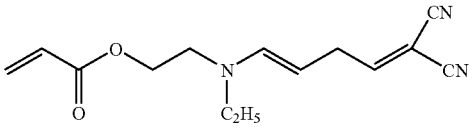

(UV-14)

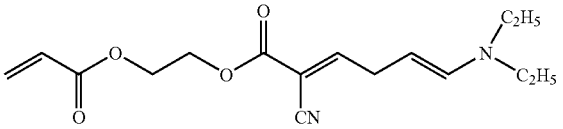

(UV-15)

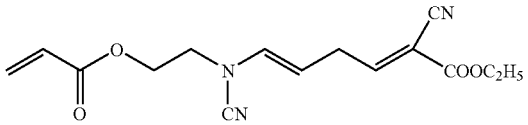

(UV-16)

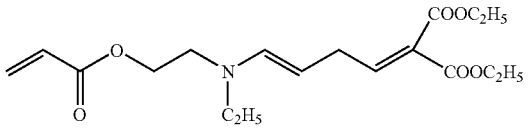

(UV-17)

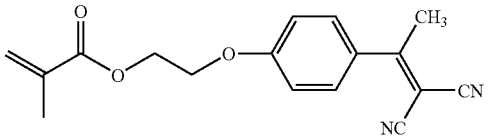

(UV-18)

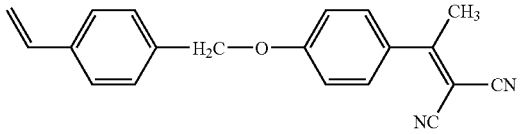

-continued (UV-19)

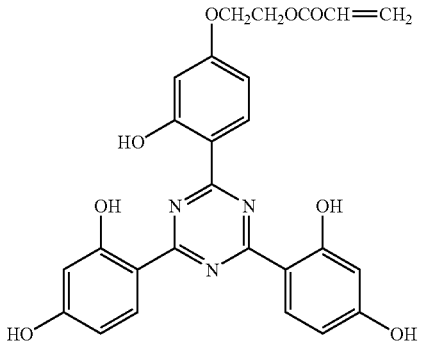

Examples of the non-UV absorbing monomers that can be copolymerized with the UV absorbing monomers described above, as well as other UV absorbing monomers, include acrylic acid, α-alkylacrylic acid, e.g., methacrylic acid, etc., ester or amide derived from an acrylic acid, e.g., acrylamide, methacrylamide, hydroxymethylacrylamide, t-butylacrylamide, diacetone acrylamide, methyl acrylate, ethyl acrylate, n-propylacrylate, n-butyl acrylate, t-butyl acrylate, isobutyl acrylate, 2-ethylhexyl acrylate, n-octyl acrylate, lauryl acrylate, 2-ethoxyethyl acrylate, 2-methoxyethyl acrylate, methyl methacrylate, ethyl methacrylate, n-butyl methacrylate, 2-hydroxyl methacrylate, etc., vinyl ester, e.g., vinyl acetate, vinyl propionate, vinyl laurate, etc., acrylonitrile, methacrylonitrile, aromatic vinyls, e.g., styrene and derivatives such as vinyl toluene, divinylbenzene, vinyl acetophenone, sulfostyrene, etc., itaconic acid, citraconic acid, crotonic acid, vinylidene chloride, a vinyl alkyl ether, e.g., vinyl ethyl ether, etc., ester of maleic acid, N-vinyl-2-pyrrolidone, N-vinylpyridine, 2- or 4-vinylpyridine, sulfonic acid containing monomers, e.g., acrylamido-2,2'-dimethyl-propane sulfonic acid, 2-sulfoethyl methacrylate, 3-sulfopropyl methacylate, etc.

Examples of binders that can be used to bind the UV absorbing latex particulates together include water soluble polymers such as polyvinyl alcohol, cationic polyvinylalcohol, acetoacetylated polyvinylalcohol, silylated polyvinylalcohol, carboxylated polyvinylalcohol, polyvinylpyrrolidone, copolymer of polyvinylacetate and polyvinylpyrrolidone, copolymer of polyvinylalcohol and polyvinylpyrrolidone, cationic polyvinylpyrrolidone, gelain, hydroxyethylcellulose, methyl cellulose, and polymer latex with glass transition temperature lower than 20° C., such as styrene butadiene latex, styrene acrylic latex, vinyl acrylic latex, all acrylic latex, polyurethane dispersions, and polyester dispersions.

With respect to the physical dimensions and other physical properties of the UV absorbing latex particulates that can be used, the particulate size is typically smaller than that of the hollow particulate size, though this is not always the case. In one embodiment, cationic latexes can be preferred for use, though other charged and non-charged latexes can be effective for use with some printing systems. The weight ratio of the UV absorbing monomers to diluent or other monomers can be from 100:0 to 10:90. In a more detailed embodiment, the UV absorbing monomers to diluent or other monomers can be from 80:20 to 40:60. Particulate size of the polymeric UV absorbing latex particulates can be from 0.05 μm to 1 μm, and in a more detailed embodiment, from 0.1μ to 0.2 μm. In further detail, the glass transition temperature of the UV absorbing latex particulates formed can be from 50° C. to 120° C., and in another embodiment, from 60° C. to 100° C. As mentioned, two or more of UV absorbing monomers can be copolymerized together (with or without one or more diluent or other monomer(s)), or alternatively, a single UV absorbing monomer can be copolymerized with one or more diluent or other monomer(s).

There are multiple methods that can be employed in preparing the particulate polymeric UV absorbers of the present invention, such as emulsion polymerization, dispersion polymerization, or suspension polymerization, as are known by those skilled in the art. Most of these UV absorbing monomers are solid at room temperature, and thus, more traditional processes of carrying out emulsion polymerization have been modified. For example, the preparation of emulsion polymers from solid hydrophobic monomers can be by methods such as those described in JP 8662501, JP 6162501, and EP 0 321 399. These methods typically liquefy the monomers by melting them before polymerization. Alternatively, preparation can be by dissolving solid monomer and other comonomers in an inert solvent, and then delivering the monomer solution to a polymerization vessel containing water, surfactant, and initiator, either batchwise or semi-continuously. Such a method is described in U.S. Pat. No. 4,080,211. In another preparative embodiment, U.S. Pat. No. 3,926,436 and EP 0 185 793 describe emulsion polymerization processes in which an organic cosolvent and an emulsifying agent are not required, but rather, an ionic comonomer containing sulfonate functional group is used. In another embodiment, U.S. Pat. No. 4,340,664 describes another emulsion polymerization process where organic cosolvent is not required, but rather, an inorganic comonomer that contains a hydrophobic hydrocarbon chain of at least 8 carbon atoms and a strong hydrophilic group formed by a sulfonic, sulfuric, or phosphonic acid group or the salt thereof, is used. Alternatively, U.S. Pat. No. 5,747,585 describes a method of concurrently metering in pre-emulsified solid monomers dispersion with liquid diluent monomer together in a reaction vessel to form polymer latex continuously. These methods are provided as exemplary, as other preparative methods can be used, as would be known to those skilled in the art.

Also, in FIG. 1, an ink-jet ink 28 is shown as it is applied to the media sheet 10. The ink-jet ink, upon ejection from an ink-jet printer (not shown), can be configured to penetrate and substantially pass by the UV absorbing latex particulates 24 of the UV protection layer 22, and become deposited within voids 18 of the hollow particulates 16, as well as around the hollow particulates, as shown generally at 28.

The ink-jet inks 28 that can be used in accordance with embodiments of the present invention are typically prepared as a dye is at least partially solvated in an aqueous formulation or liquid vehicle. Typically the ink-jet ink compositions of the present invention have a viscosity of between about 0.8 to about 8 cps. In one aspect of the present invention, the liquid vehicle can comprise from about 70 wt % to about 99.9 wt % of the ink-jet ink composition.

Regarding the liquid vehicle, cosolvents that can be included in the ink-jet ink compositions of the present invention include water soluble organic cosolvents, such as aliphatic alcohols, aromatic alcohols, diols, glycol ethers, poly (glycol) ethers, lactams, formamides, acetamides, long chain alcohols, ethylene glycol, propylene glycol, diethylene glycols, triethylene glycols, glycerine, dipropylene glycols, glycol butyl ethers, polyethylene glycols, polypropylene glycols, amides, ethers, carboxylic acids, esters, organosulfides, organosulfoxides, sulfones, alcohol derivatives, carbitol, butyl carbitol, cellosolve, ether derivatives, amino alcohols, and ketones. For example, cosolvents can include primary aliphatic alcohols of 30 carbons or less, primary aromatic alcohols of 30 carbons or less, secondary aliphatic alcohols of 30 carbons or less, secondary aromatic alcohols of 30 carbons or less, 1,2-diols of 30 carbons or less, 1,3-diols of 30 carbons or less, 1,5-diols of 30 carbons or less, ethylene glycol alkyl ethers, propylene glycol alkyl ethers, poly(ethylene glycol) alkyl ethers, higher homologs of poly(ethylene glycol) alkyl ethers, poly(propylene glycol) alkyl ethers, higher homologs of poly(propylene glycol) alkyl ethers, lactams, substituted formamides, unsubstituted formamides, substituted acetamides, and unsubstituted acetamides. Specific examples of cosolvents that are preferably employed in the practice of this invention include, but are not limited to, 1,5-pentanediol, 2-pyrrolidone, 2-ethyl-2-hydroxymethyl-1,3-propanediol, diethylene glycol, 3-methoxybutanol, and 1,3-dimethyl-2-imidazolidinone. Cosolvents can be added to reduce the rate of evaporation of water in the ink-jet to minimize clogging or other properties of the ink such as viscosity, pH, surface tension, optical density, and print quality. The cosolvent concentration can range from about 0.5 wt % to about 30 wt %, and in one embodiment is from about 1 wt % to about 20 wt %. Multiple cosolvents can also be used, as is known in the art.

Various buffering agents or pH adjusting agents can also be optionally used in the ink-jet ink compositions of the present invention. Typical buffering agents include such pH control solutions as hydroxides of alkali metals and amines, such as lithium hydroxide, sodium hydroxide, potassium hydroxide; citric acid; amines such as triethanolamine, diethanolamine, and dimethylethanolamine; hydrochloric acid; and other basic or acidic components which do not substantially interfere with the bleed control or optical density characteristics of the present invention. If used, buffering agents typically comprise less than about 10 wt % of the ink-jet ink composition.

In another aspect of the present invention, various biocides can be used to inhibit growth of undesirable microorganisms. Several non-limiting examples of suitable biocides include benzoate salts, sorbate salts, commercial products such as NUOSEPT (Nudex, Inc., a division of Huls America), UCARCIDE (Union Carbide), VANCIDE (RT Vanderbilt Co.), and PROXEL (ICI Americas) and other known biocides. Typically, such biocides comprise less than about 5 wt % of the ink-jet ink composition and often from about 0.1 wt % to about 0.25 wt %.

Surfactants can also be present, such as alkyl polyethylene oxides, alkyl phenyl polyethylene oxides, polyethylene oxide (PEO) block copolymers, acetylenic PEO, PEO esters, PEO amines, PEO amides, and dimethicone copolyols can be used. If used, such surfactants can be present at from 0.01% to about 10% by weight of the ink-jet ink composition.

Turning to the dyes that can be used with the present invention, examples include a large number of water-soluble acid and direct dyes. Specific examples of such dyes include the Pro-Jet series of dyes available from Avecia Ltd., including Pro-Jet Yellow I (Direct Yellow 86), Pro-Jet Magenta I (Acid Red 249), Pro-Jet Cyan I (Direct Blue 199), Pro-Jet Black I (Direct Black 168), and Pro-Jet Yellow 1-G (Direct Yellow 132); Aminyl Brilliant Red F-B (Sumitomo Chemical Co.); the Duasyn line of "salt-free" dyes available from Hoechst, such as Duasyn Direct Black HEF-SF (Direct Black 168), Duasyn Black RL-SF (Reactive Black 31), Duasyn Direct Yellow 6G-SF VP216 (Direct Yellow 157), Duasyn Brilliant Yellow GL-SF VP220 (Reactive Yellow 37), Duasyn Acid Yellow XX-SF VP413 (Acid Yellow 23), Duasyn Brilliant Red F3B-SF VP218 (Reactive Red 180), Duasyn Rhodamine B-SF VP353 (Acid Red 52), Duasyn Direct Turquoise Blue FRL-SF VP368 (Direct Blue 199), and Duasyn Acid Blue AE-SF VP344 (Acid Blue 9); mixtures thereof; and the like. Further examples include Tricon Acid Red 52, Tricon Direct Red 227, and Tricon Acid Yellow 17 (Tricon Colors Incorporated), Bernacid Red 2BMN, Pontamine Brilliant Bond Blue A, BASF X-34, Pontamine, Food Black 2, Catodirect Turquoise FBL Supra Conc. (Direct Blue 199, Carolina Color and Chemical), Special Fast Turquoise 8GL Liquid (Direct Blue 86, Mobay Chemical), Intrabond Liquid Turquoise GLL (Direct Blue 86, Crompton and Knowles), Cibracron Brilliant Red 38-A (Reactive Red 4, Aldrich Chemical), Drimarene Brilliant Red X-2B (Reactive Red 56, Pylam, Inc.), Levafix Brilliant Red E-4B (Mobay Chemical), Levafix Brilliant Red E-6BA (Mobay Chemical), Pylam Certified D&C Red #28 (Acid Red 92, Pylam), Direct Brill Pink B Ground Crude (Crompton & Knowles), Cartasol Yellow GTF Presscake (Sandoz, Inc.), Tartrazine Extra Conc. (FD&C Yellow #5, Acid Yellow 23, Sandoz, Inc.), Catodirect Yellow RL (Direct Yellow 86, Carolina Color and Chemical), Cartasol Yellow GTF Liquid Special 110 (Sandoz, Inc.), D&C Yellow #10 (Yellow 3, Tricon), Yellow Shade 16948 (Tricon), Basacid Black X34 (BASF), Carta Black 2GT (Sandoz, Inc.), Neozapon Red 492 (BASF), Orasol Red G (Ciba-Geigy), Direct Brilliant Pink B (Crompton-Knolls), Aizen Spilon Red C-BH (Hodagaya Chemical Company), Kayanol Red 3BL (Nippon Kayaku Company), Levanol Brilliant Red 3BW (Mobay Chemical Company), Levaderm Lemon Yellow (Mobay Chemical Company), Aizen Spilon Yellow C-GNH (Hodagaya Chemical Company), Spirit Fast Yellow 3G, Sirius Supra Yellow GD 167, Cartasol Brilliant Yellow 4GF (Sandoz), Pergasol Yellow CGP (Ciba-Geigy), Orasol Black RL (Ciba-Geigy), Orasol Black RLP (Ciba-Geigy), Savinyl Black RLS (Sandoz), Dermacarbon 2GT (Sandoz), Pyrazol Black BG (ICI Americas), Morfast Black Conc A (Morton-Thiokol), Diazol Black RN Quad (ICI Americas), Orasol Blue GN (Ciba-Geigy), Savinyl Blue GLS (Sandoz, Inc.), Luxol Blue MBSN (Morton-Thiokol), Sevron Blue 5GMF (ICI Americas), and Basacid Blue 750 (BASF); Levafix Brilliant Yellow E-GA, Levafix Yellow E2RA, Levafix Black EB, Levafix Black E-2G, Levafix Black P-36A, Levafix Black PN-L, Levafix Brilliant Red E6BA, and Levafix Brilliant Blue EFFA, all available from Bayer; Procion Turquoise PA, Procion Turquoise HA, Procion Turquoise Ho5G, Procion Turquoise H-7G, Procion Red MX-5B, Procion Red H8B (Reactive Red 31), Procion Red MX 8B GNS, Procion Red G, Procion Yellow MX-8G, Procion Black H-EXL, Procion Black P-N, Procion Blue MX-R, Procion Blue MX-4GD, Procion Blue MX-G, and Procion Blue MX-2GN, all available from ICI Americas; Cibacron Red F-B, Cibacron Black BG, Lanasol Black B, Lanasol Red 5B, Lanasol Red B, and Lanasol Yellow 46, all available from Ciba-Geigy; Baslien Black P-BR, Baslien Yellow EG, Baslien Brilliant Yellow P-3GN, Baslien Yellow M-6GD, Baslien Brilliant Red P-3B, Baslien Scarlet E-2G, Baslien Red E-B, Baslien Red E-7B, Baslien Red M-5B, Baslien Blue E-R, Baslien Brilliant Blue P-3R, Baslien Black P-BR, Baslien Turquoise Blue P-GR, Baslien Turquoise M-2G, Baslien Turquoise E-G, and Baslien Green E-6B, all available from BASF; Sumifix Turquoise Blue G, Sumifix Turquoise Blue H-GF, Sumifix Black B, Sumifix Black H-BG, Sumifix Yellow 2GC, Sumifix Supra Scarlet 2GF, and Sumifix Brilliant Red 5BF, all available from Sumitomo Chemical Company; Intracron Yellow C-8G, Intracron Red C-8B, Intracron Turquoise Blue GE, Intracron Turquoise HA, and Intracron Black RL, all available from Crompton and Knowles, Dyes and Chemicals Division; mixtures thereof, and the like. This list is intended to be merely exemplary, and should not be considered limiting.

Figure 2:
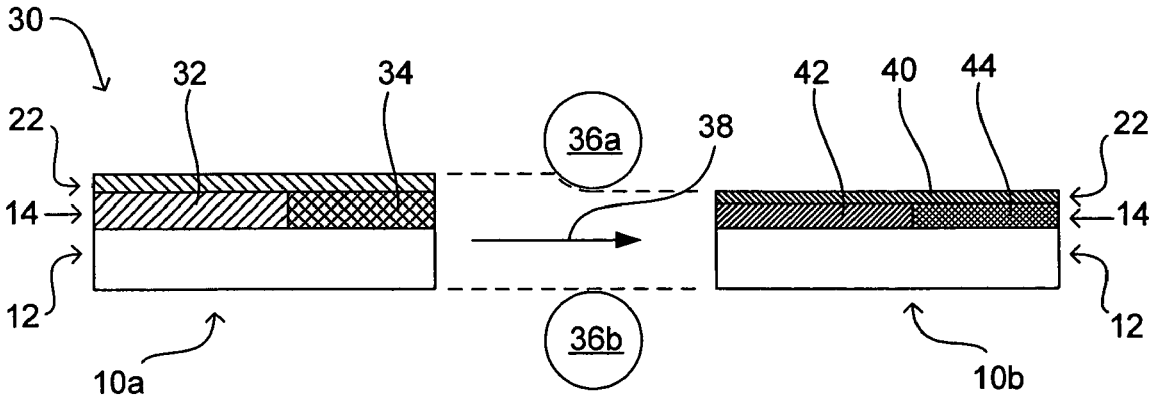
FIG. 2 schematically depicts a method in accordance with embodiments of the present invention.

Referring now to FIG. 2, a system, shown generally at 30, that can be used to prepare a fused ink-jet image with high image quality, air fastness, and light stability, is provided in accordance with embodiments of the present invention. Specifically, a media sheet in a first configuration 10*a* and the same media sheet in a second configuration 10*b* is shown, wherein each configuration includes a substrate 12, an ink receiving layer 14, and a UV protection layer 22. In the first configuration, the ink receiving layer in two sections. A first section 32 depicts the ink receiving layer without having ink-jet ink deposited therein. A second section 34 depicts the ink receiving layer having ink-jet ink deposited therein. The UV protection layer is substantially the same over its entire length as it is typically configured to allow in ink-jet ink to pass therethrough.

The media sheet of the second configuration 10*b*, including ink-jet ink within a portion of the ink receiving layer, depicts the media sheet and deposited ink in a fused state. Specifically, the media sheet of the first configuration 10*a* can be passed through a pair of fusion rollers 36*a*,36*b* in direction 38. The heat rollers can be like unto those used in conventional laser printers, as are known in the art. Applying heat and pressure can provide for high gloss and uniformity of the printed media sheet, and can cause the print to likewise exhibit high gamut, good air fade, and good lightfastness. Though a pair of fusion rollers is shown, other fusion systems can be used as well, such as those that apply heat and do not apply pressure, e.g., a heat lamp or other non-contact radiant heat, electromagnetic radiation, etc.

Due to the application of heat, and optionally, pressure, the ink receiving layer and the UV protection layer become compressed and fused. Further, the large open particulates that contain ink, as depicted by the second section 34 of the first configuration 10*a*, becomes fused with the ink. Thus, a fused UV protection layer 40, a fused ink receiving layer section without ink 42, and a fused ink receiving layer section with ink 44 are formed.

In the system shown, the ink receiving layer 14 and UV protection layer 22 both act to protect the printed ink, and particularly the dye present in the ink, from air fade. This is accomplished as both polymeric materials can be used to lock the ink-jet ink within a polymeric matrix that insulates the dye from the surrounding air, such as by forming a film. However, the UV protection layer also provides the added benefit of providing a barrier to harmful UV light that can cause light fastness reduction.

EXAMPLES

The following examples illustrate the embodiments of the invention that are presently best known. However, it is to be understood that the following are only exemplary or illustrative of the application of the principles of the present invention. Numerous modifications and alternative compositions, methods, and systems may be devised by those skilled in the art without departing from the spirit and scope of the present invention. The appended claims are intended to cover such modifications and arrangements. Thus, while the present invention has been described above with particularity, the following examples provide further detail in connection with what are presently deemed to be the most practical and preferred embodiments of the invention.

Example 1

Preparation of Ink Receiving Layer Coating Comprising Hollow Plastic Pigments

A 58.3 g amount of the plastic hollow particle HS-3000 (26.03 wt % solid, 1 μm diameter, Dow Chemical), 7.3 g of Gohsenol K-210 (20.7 wt % solid, Nippon Gohsei Chemical), 2.1 g of Agefloc WT35VLV (36.23 wt % solid from Ciba Geigy Co.), 0.2 g of Triton X-100, and 12 g of D.I. water were mixed with a mechanical stirrer until the composition became homogeneous. A final wt % solid of the coating fluid prepared was about 22 wt %. The resulting fluid was coated on a 9 mils gel-subbed photobase with a #50 Mylar rod. The coating weight of the ink receiving layer was about 20 g/m$^2$.

Example 2

Preparation of Polymeric UV Absorbing Latex Particulates (PUV-1)

A latex of 2-hydroxy-5-(methacryloxyethyl)phenyl-2H-benzotriazole (UV-2, Tinuvin R796 from Ciba Specialty) and methylmethacrylate was prepared as follows. A solid dispersion or-slurry comprising 22.9 g of 2-hydroxy-5-(methacryloxyethyl)phenyl-2H-benzotriazole, 3.2 g of dioctyl ester of sodium sulfosuccinnic acid (Aerosol OT from American Cyanamide), 0.379 g of ammonium persulfate, and 116.8 g of water was mixed and milled for 10 minutes using a Ross mixer until a fine dispersion was obtained. The slurry was continuously stirred to prevent settling. Next, a 2 liter 4-neck Morton flask equipped with nitrogen inlet, mechanical lab stirrer, and condenser was charged with 39.2 g of deionized water and 0.8 g of Aerosol OT. The reactor was heated to 80° C. while purging with nitrogen for 30 minutes. Next, 0.095 g of ammonium persulfate was added to the reactor and stirred for 5 minutes. The solid dispersion was pumped into the reactor over five hours concurrently with a second feed stream of 17.1 g of methylmethacrylate monomer. The total polymerization time was 8 hours, which resulted in finely dispersed latex particulates. The latex particulates were cooled and filtered. The resulting solids percentage was about 20.1 wt %, the resulting particulate size was about 33 nm (as meastured by Microtrac UPA-150), and the glass transition temperature (Tg) was about 95° C.

Example 3

Preparation of Polymeric UV Absorbing Latex Particulates (PUV-2)

A latex of 2-hydroxy-5-(methacryloxyethyl)phenyl-2H-benzotriazole (UV-2, Tinuvin R796 from Ciba Specialty) and butylmethacrylate was prepared as follows. A solid dispersion or-slurry comprising 22.9 g of 2-hydroxy-5-(methacryloxyethyl)phenyl-2H-benzotriazole, 3.2 g of dioctyl ester of sodium sulfosuccinnic acid (Aerosol OT from American Cyanamide), 0.379 g of ammonium persulfate, and 116.8 g of water was mixed and milled for 10 minutes using a Ross mixer until a fine dispersion was obtained. The slurry was continuously stirred to prevent settling. Next, a 2 liter 4-neck Morton flask equipped with nitrogen inlet, mechanical lab stirrer, and condenser was charged with 39.2 g of deionized water and 0.8 g of Aerosol OT. The reactor was heated to 80° C. while purging with nitrogen for 30 minutes. Next, 0.095 g of ammonium persulfate was added to the reactor and stirred for 5 minutes. The solid dispersion was pumped into the reactor over five hours concurrently with a second feed stream of 17.1 g of butylmethacrylate monomer. The total polymerization time was 8 hours, which resulted in finely dispersed latex particulates. The latex particulates were cooled and filtered. The resulting solids percentage was about 19.8 wt %, the resulting particulate size was about 45 nm (as meastured by a Microtrac UPA-150), and the glass transition temperature (Tg) was about 75° C.

Example 4

Overcoating UV Absorbing Latex Particulates on Fusible Ink Receiving Layer

About 100 g of the polymeric UV particulates (PUV-1) prepared in accordance with Example 2 (20.1 wt % solid), 13.4 g of Mowiol 26-88 binder (15 wt % solid, Clariant Corp.), 1 g of boric acid (4 wt % solid), and 1 g of 5 wt % Triton X-100 were mixed and stirred for 30 minutes. The ink receiving media prepared in accordance with Example 1 was then sprayed with D.I. water to saturate the coating, and the excess was wiped with paper towel. The coating fluid prepared in accordance with the present example was then coated onto the pre-soaked ink receiving layer using a #8 Mylar rod, providing a dry coating weight of 3 g/m$^2$.

Example 5

Printing and Fusing Printed Image

An HP Deskjet 970 was used to print a test image on the inkjet media sheet prepared in accordance with Example 4. The print mode selected was HP premium plus glossy media. After printing, the image was dried overnight. The next morning, a 3 mil PET film treated with silicon release agent was place on the top of the printed image (for purposes of protecting the image during the fusion process), and then the protected image was passed through a fusing roller at 0.1 inch/sec at 100 psi and 140° C. The PET film was then carefully peeled off, leaving a glossy and fused image.

While the invention has been described with reference to certain preferred embodiments, those skilled in the art will appreciate that various modifications, changes, omissions, and substitutions can be made without departing from the spirit of the invention. It is therefore intended that the invention be limited only by the scope of the appended claims.

What is claimed is:

1. A media sheet, comprising:

a) a media substrate;

b) an ink receiving layer applied as a coating to at least one surface of the substrate, said ink receiving layer comprising hollow particulates; and c) a UV protection layer applied as a coating to the ink receiving layer, said UV protection layer including UV absorbing latex particulates that are from 0.05 μm to 1 μm in size, and have a glass transition temperature (Tg) from 50° C. to 120° C., and said UV protection layer formulated to allow an ink to at least partially pass therethrough and become deposited on the ink receiving layer.

2. A media sheet as in claim 1, wherein the ink receiving layer includes a binder for binding the hollow particulates.

3. A media sheet as in claim 1, wherein the UV protection layer includes a binder for binding UV absorbing latex particulates.

4. A media sheet as in claim 1, wherein the hollow particulates have a void volume from 30% to 70%.

5. A media sheet as in claim 1, wherein the hollow particulates are from 0.3 μm to 5 μm in size, and have a glass transition temperature (Tg) from 50° C. to 120° C.

6. A media sheet as in claim 2, wherein the hollow particulate to binder ratio is from 95:5 to 50:50 by weight.

7. A media sheet as in claim 1, wherein the ink receiving layer is applied at from 5 $g/m^2$ to 40 $g/m^2$.

8. A media sheet as in claim 1, wherein the UV absorbing latex particulates include at least one UV absorbing monomer, said UV absorbing monomer being an ethylenically unsaturated compound having a UV absorbing group covalently attached thereto, said UV absorbing latex particulates having a UV absorbing monomer to diluent monomer ratio from 100:0 to 10:90 by weight.

9. A media sheet as in claim 8, wherein the UV absorbing latex particulates are copolymers including at least one non-UV absorbing monomer.

10. A media sheet as in claim 1, wherein the UV absorbing layer is applied at from 0.2 $g/m^2$ to 5 $g/m^2$.

11. A media sheet as in claim 1, wherein the UV absorbing latex particulates have a strong absorbance between 300 nm to 420 nm, and a lower absorbance above 420 nm.

12. A system for preparing a fused ink-jet image, comprising:

a) a media sheet, including:
   i) a media substrate;
   ii) an ink receiving layer applied as a coating to at least one surface of the substrate, said ink receiving layer comprising hollow particulates comprising internal voids, and
   iii) a UV protection layer applied as a coating to the ink receiving layer, said UV protection layer including UV absorbing latex particulates;

b) an ink-jet ink including a dye, said ink-jet ink configured for printing onto the media sheet, wherein upon printing, the ink-jet ink substantially passes through the UV protection layer and is taken within said voids of the hollow particulates; and c) a fusion system configured for fusing the UV protection layer and the ink receiving layer after printing of the ink-jet ink.

13. A system as in claim 12, wherein the ink receiving layer includes a binder, said hollow particulate to binder ratio being from 95:5 to 50:50 by weight.

14. A system as in claim 12, wherein the hollow particulates have a void volume from 30% to 70%.

15. A system as in claim 12, wherein the hollow particulates are from 0.3 μm to 2 μm in size, and have a glass transition temperature (Tg) from 50° C. to 120° C.

16. A system as in claim 12, wherein the ink receiving layer is applied at from to 5 $g/m^2$ to 40 $g/m^2$.

17. A system as in claim 12, wherein the UV absorbing latex particulates include at least one UV absorbing monomer, said UV absorbing monomer being an ethylenically unsaturated compound having a UV absorbing group covalently attached thereto, said UV absorbing latex particulates having a UV absorbing monomer to diluent monomer ratio from 100:0 to 10:90 by weight.

18. A system as in claim 17, wherein the UV absorbing latex particulates are copolymers including at least one non-UV absorbing monomer.

19. A system as in claim 12, wherein the UV absorbing layer is applied at from 0.2 $g/m^2$ to 5 $g/m^2$.

20. A system as in claim 12, wherein the UV absorbing latex particulates have a strong absorbance between 300 nm to 420 nm, and a lower absorbance above 420 nm.

21. A system as in claim 12, wherein the UV absorbing latex particulates are from 0.05 μm to 1 μm in size, and have a glass transition temperature (Tg) from 50° C. to 120° C.

22. A system as in claim 12, wherein said ink receiving layer comprises voids between said hollow particulates, and the ink-jet ink is configured to substantially pass through the UV protection layer and fill said voids within and between the hollow particulates.

23. A system as in claim 12, wherein the fusion system comprises a pair of rollers configured to apply heat and pressure to the media sheet after application of the ink-jet ink, thereby forming a fused ink-jet image.

24. A method of preparing a fused ink-jet image, comprising:

a) ink-jetting an ink-jet ink onto a media sheet, said ink-jet ink including a dye, and said media sheet including an ink receiving layer and a UV protection layer, said ink receiving layer including hollow particulates comprising internal voids, and including voids between said hollow particulates, and said UV protection layer including UV absorbing latex particulates, wherein said ink-jet ink at least partially passes through the UV protection layer and is received by the ink receiving layer; and b) fusing the UV protection layer and the ink receiving layer after the ink-jetting step.

25. A method as in claim 24, wherein the fusing step is by applying heat and pressure to the media sheet having the ink-jet ink printed thereon.

26. A method as in claim 24, wherein the fusing step is by applying heat to the media sheet having the ink-jet ink printed thereon.

27. A method as in claim 24, further comprising the preliminary step of preparing the media sheet by applying the ink receiving layer on to the substrate, and subsequently applying the UV protection layer on to the ink receiving layer.

28. A method as in claim 24, wherein the ink-jetting step includes allowing the ink-jet ink to fill said voids within and between the hollow particulates.

29. A method as in claim 24, wherein the fusing step causes the UV protection layer and the ink receiving layer to form a film that at least partially insulates the ink-jet ink from the surrounding air.

30. A method as in claim 24, wherein the fusing step causes the UV protection layer to form a film that at least partially insulates the ink-jet ink from the UV light.

31. A media sheet, comprising:

a) a media substrate;

b) an ink receiving layer applied as a coating to at least one surface of the substrate, said ink receiving layer comprising hollow particulates, said hollow particulates having a void volume from 30% to 70%; and c) a UV protection layer applied as a coating to the ink receiving layer, said UV protection layer including UV absorbing latex particulates and said UV protection layer formulated to allow an ink to at least partially pass therethrough and become deposited on the ink receiving layer.

32. A media sheet, comprising:

a) a media substrate;

b) an ink receiving layer applied as a coating to at least one surface of the substrate, said ink receiving layer comprising hollow particulates, said hollow particulates being from 0.3 μm to 5 μm in size, and having a glass transition temperature (Tg) from 50° C. to 120° C.; and c) a UV protection layer applied as a coating to the ink receiving layer, said UV protection layer including UV absorbing latex particulates and said UV protection layer formulated to allow an ink to at least partially pass therethrough and become deposited on the ink receiving layer.

33. A media sheet, comprising:

a) a media substrate;

b) an ink receiving layer applied as a coating to at least one surface of the substrate, said ink receiving layer comprising hollow particulates bound together with a binder, wherein the hollow particulate to binder ratio is from 95:5 to 50:50 by weight; and c) a UV protection layer applied as a coating to the ink receiving layer, said UV protection layer including UV absorbing latex particulates and said UV protection layer formulated to allow an ink to at least partially pass therethrough and become deposited on the ink receiving layer.

34. A media sheet, comprising:

a) a media substrate;

b) an ink receiving layer applied as a coating to at least one surface of the substrate, said ink receiving layer comprising hollow particulates; and c) a UV protection layer applied as a coating to the ink receiving layer, said UV protection layer including UV absorbing latex particulates, said UV protection layer formulated to allow an ink to at least partially pass therethrough and become deposited on the ink receiving layer, wherein at least one of i) the ink receiving layer is applied at from 5 $g/m^2$ to 40 $g/m^2$, or ii) the UV absorbing layer is applied at from 0.2 $g/m^2$ to 5 $g/m^2$.

35. A media sheet, comprising:

a) a media substrate;

b) an ink receiving layer applied as a coating to at least one surface of the substrate, said ink receiving layer comprising hollow particulates; and c) a UV protection layer applied as a coating to the ink receiving layer, said UV protection layer including UV absorbing latex particulates, said UV protection layer formulated to allow an ink to at least partially pass therethrough and become deposited on the ink receiving layer, wherein the UV absorbing latex particulates include at least one UV absorbing monomer, said UV absorbing monomer being an ethylenically unsaturated compound having a UV absorbing group covalently attached thereto, said UV absorbing latex particulates having a UV absorbing monomer to diluent monomer ratio from 100:0 to 10:90 by weight.

36. A media sheet as in claim 35, wherein the UV absorbing latex particulates are copolymers including at least one non-UV absorbing monomer.

37. A media sheet, comprising:

a) a media substrate;

b) an ink receiving layer applied as a coating to at least one surface of the substrate, said ink receiving layer comprising hollow particulates; and c) a UV protection layer applied as a coating to the ink receiving layer, said UV protection layer including UV absorbing latex particulates, said UV protection layer formulated to allow an ink to at least partially pass therethrough and become deposited on the ink receiving layer, wherein the UV absorbing latex particulates have a strong absorbance between 300 nm to 420 nm, and a lower absorbance above 420 nm.

* * * * *

UNITED STATES PATENT AND TRADEMARK OFFICE

CERTIFICATE OF CORRECTION

PATENT NO. : 7,441,886 B2
APPLICATION NO. : 10/773826
DATED : October 28, 2008
INVENTOR(S) : Tienteh Chen It is certified that error appears in the above-identified patent and that said Letters Patent is hereby corrected as shown below:

In column 9, line 20, delete "

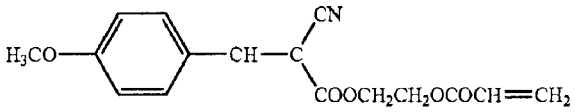

" and insert --

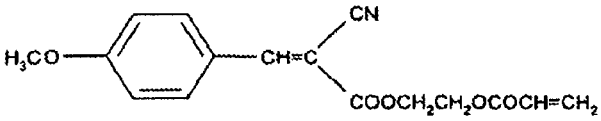

--, therefor.

In column 11, line 5, delete "0.1 μ" and insert -- 0.1 μm --, therefor.

In column 17, line 54, in Claim 15, delete "2 μm" and insert -- 5 μm --, therefor.

In column 17, line 57, in Claim 16, after "from" delete "to".

Signed and Sealed this

Fifteenth Day of June, 2010

David J. Kappos

David J. Kappos
*Director of the United States Patent and Trademark Office*